US008850735B2

(12) United States Patent
Kenney

(10) Patent No.: US 8,850,735 B2
(45) Date of Patent: Oct. 7, 2014

(54) UPPER RECEIVER AND HAND GUARD WITH CABLE ROUTING GUIDE

(71) Applicant: RA Brands, L.L.C., Madison, NC (US)

(72) Inventor: Daniel E. Kenney, Cecilia, KY (US)

(73) Assignee: RA Brands, L.L.C., Madison, NC (US)

( * ) Notice: Subject to any disclaimer, the term of this patent is extended or adjusted under 35 U.S.C. 154(b) by 31 days.

(21) Appl. No.: 13/799,824

(22) Filed: Mar. 13, 2013

(65) Prior Publication Data

US 2014/0115936 A1 May 1, 2014

Related U.S. Application Data

(60) Provisional application No. 61/718,974, filed on Oct. 26, 2012.

(51) Int. Cl.

| | |
|---|---|
| ***F41A 23/16*** | (2006.01) |
| ***F41C 23/16*** | (2006.01) |
| ***F41A 3/66*** | (2006.01) |
| ***F41G 11/00*** | (2006.01) |

(52) U.S. Cl.

CPC . *F41A 3/66* (2013.01); *F41C 23/16* (2013.01); *F41G 11/003* (2013.01)

USPC ..... 42/72; 42/106

(58) Field of Classification Search

USPC ..... 42/84, 71.01, 72, 106

See application file for complete search history.

(56) References Cited

U.S. PATENT DOCUMENTS

| | | | | |
|---|---|---|---|---|
| 7,581,954 | B2 | 9/2009 | Schavone | |
| 7,627,975 | B1 * | 12/2009 | Hines | 42/84 |
| 7,775,150 | B2 * | 8/2010 | Hochstrate et al. | 89/193 |
| 7,845,105 | B1 * | 12/2010 | Cahill | 42/72 |
| 8,028,459 | B2 | 10/2011 | Williams | |
| 8,028,460 | B2 | 10/2011 | Williams | |

(Continued)

FOREIGN PATENT DOCUMENTS

WO WO 2010-141428 A1 12/2010

OTHER PUBLICATIONS

Nick Leghorn, New from Remington Defense: R5 RGP Gas Piston AR-15, The Truth About Guns.com, posted Jan. 11, 2012, 10 pages, http://www.thetruthaboutguns.com/2012/01/fighirn/new-from-remington-defense-r5-rgp-gas-piston-ar-15/. (accessed Sep. 25, 2012).

(Continued)

*Primary Examiner* — Jonathan C Weber

(74) *Attorney, Agent, or Firm* — Womble Carlyle Sandridge & Rice, LLP

(57) ABSTRACT

A monolithic upper receiver/hand guard is provided for use with a firearm. The monolithic upper receiver/hand guard can include an upper receiver section, a hand guard section, and an interrupted optics rail extending along the top of the upper receiver section and the hand guard section. Cable routing features can be defined in the hand guard section and/or the upper receiver section for helping to control wires and cables extending from or between peripheral devices and accessories, which can be mounted on the monolithic upper receiver/hand guard. The cable routing features can include one or more crossover cable guides disposed in respective channels in the interrupted optics rail. The crossover cable guide can include one or more grooves for receiving a portion of a cable passing from one side of the monolithic upper receiver/hand guard to the other for connecting two peripheral devices, for example.

18 Claims, 6 Drawing Sheets

(56) References Cited

U.S. PATENT DOCUMENTS

| | | | | |
|---|---|---|---|---|
| 8,104,211 | B2 | 1/2012 | Darian | |
| 8,141,288 | B2 * | 3/2012 | Dodd et al. | 42/84 |
| 8,146,282 | B2 * | 4/2012 | Cabahug et al. | 42/85 |
| 8,322,064 | B2 * | 12/2012 | Cabahug et al. | 42/85 |
| 8,397,418 | B2 * | 3/2013 | Cabahug et al. | 42/85 |
| 8,402,683 | B2 * | 3/2013 | Cabahug et al. | 42/85 |
| 8,443,539 | B2 * | 5/2013 | Cabahug et al. | 42/85 |
| 8,448,368 | B2 * | 5/2013 | Cabahug et al. | 42/85 |
| 8,490,313 | B2 * | 7/2013 | Frascati et al. | 42/90 |
| 8,516,731 | B2 * | 8/2013 | Cabahug et al. | 42/84 |
| 8,607,492 | B2 * | 12/2013 | Hartley et al. | 42/72 |
| 2007/0199435 | A1 | 8/2007 | Hochstrate et al. | |
| 2010/0180485 | A1 | 7/2010 | Cabahug et al. | |
| 2010/0275489 | A1 * | 11/2010 | Cabahug et al. | 42/71.01 |
| 2010/0287809 | A1 * | 11/2010 | Williams | 42/90 |
| 2010/0307042 | A1 | 12/2010 | Jarboe et al. | |
| 2011/0167701 | A1 | 7/2011 | Williams | |
| 2011/0185617 | A1 | 8/2011 | Brixius | |
| 2011/0283586 | A1 | 11/2011 | Scallie et al. | |
| 2012/0000108 | A1 | 1/2012 | Zusman | |
| 2012/0000109 | A1 | 1/2012 | Zusman | |
| 2012/0047786 | A1 | 3/2012 | Dextraze et al. | |
| 2012/0144714 | A1 | 6/2012 | Cabahug et al. | |
| 2012/0159828 | A1 | 6/2012 | Jarboe et al. | |
| 2012/0192476 | A1 | 8/2012 | Compton et al. | |
| 2014/0092588 | A1 * | 4/2014 | Toman et al. | 362/110 |

OTHER PUBLICATIONS

Carbines, Remington Defense Catalog 2012, 2 pages, http://www.remingtonmilitary.com/Firearms/Carbines/RGP.aspx (accessed Sep. 25, 2012).

International Search Report dated Jan. 22, 2014 for International Patent Application PCT/US2013/066795 filed Oct. 25, 2013.

Written Opinion dated Jan. 22, 2014 for International Patent Application PCT/US2013/066795 filed Oct. 25, 2013.

* cited by examiner

UPPER RECEIVER AND HAND GUARD WITH CABLE ROUTING GUIDE

CROSS-REFERENCE TO RELATED APPLICATIONS

This application claims the benefit of U.S. Provisional Patent Application No. 61/718,974, filed Oct. 26, 2012.

INCORPORATION BY REFERENCE

The disclosure of U.S. Provisional Patent Application No. 61/718,974, which was filed on Oct. 26, 2012, is hereby incorporated by reference for all purposes as if presented herein in its entirety, for all purposes.

TECHNICAL FIELD

Embodiments of the disclosure are directed generally to firearms and, more particularly, to a crossover cable-routing feature of a monolithic receiver/hand guard of a firearm.

BACKGROUND INFORMATION

Firearms, such as rifles and/or shotguns, can include an upper receiver, a hand guard generally surrounding the barrel and being attached to the upper receiver, and an optics rail extending along the top of the upper receiver and/or the hand guard. In recent years, especially with regard to tactical firearms for military or law enforcement use, unitary or monolithic upper receivers with an integral hand guard have been developed, including monolithic upper receivers having a mil-std rail formed or mounted therealong. These rails enable mounting of optics such as a scope, and/or other devices therealong. Additional peripheral devices or accessories also can be mounted on the hand guard for use with the firearm. Some of the most commonly used peripheral devices, such as lights, laser arming devices, etc., can include wires or cables for power transmission, control signals, and/or communication signals. These cables can, however, become snagged or otherwise interfere with operation of the firearm and/or peripheral devices, especially when passing a cable from one side of the hand guard to the other for communication between two devices.

Accordingly, it can be seen that a need exists for an upper receiver and hand guard with cable routing features that addresses the foregoing and other related and unrelated problems in the art.

SUMMARY OF THE DISCLOSURE

Briefly described, in one embodiment of the disclosure, a monolithic upper receiver/hand guard is provided for use with a firearm. The monolithic upper receiver/hand guard can include an upper receiver, a hand guard section, and an interrupted top rail extending along the top of the upper receiver and the hand guard section. In one embodiment, the upper receiver, the hand guard section, and the interrupted optics rail are integrally formed. Alternatively, the rail can be separately mounted or affixed to the upper receiver and hand guard. Cable routing features can be defined in the rail and along the hand guard section and/or the upper receiver for helping to guide and protect control wires and cables extending from or between peripheral devices and accessories mounted on the monolithic upper receiver/hand guard. The cable routing features can include slots formed in the hand guard section, for example, and fasteners can cooperate with bores in the hand guard section along the slots for retaining one or more cables in a respective slot.

The cable routing features further will include one or more crossover cable guides disposed in respective guide/routing channels in the interrupted optics rail. In one embodiment, the crossover cable guide is integrally formed with the upper receiver section and/or the hand guard section. In another embodiment, the crossover cable guide can be an insert that is mounted on the upper receiver section and/or the hand guard section. The crossover cable guide can include one or more grooves or channels for receiving a portion of a cable passing from one side of the monolithic upper receiver/hand guard to the other for connecting two or more peripheral devices, for example. In one embodiment, the groove can extend below the interrupted optics rail so that a cable received in the groove is disposed below the interrupted optics rail. Accordingly, the cable can be placed in a protected position that is less likely to interfere with operation of a peripheral device mounted on the interrupted optics rail.

These and various other advantages, features, and aspects of the exemplary embodiments will become apparent and more readily appreciated from the following detailed description of the embodiments taken in conjunction with the accompanying drawings, as follows.

DETAILED DESCRIPTION OF THE EXEMPLARY EMBODIMENTS

Figure 1:
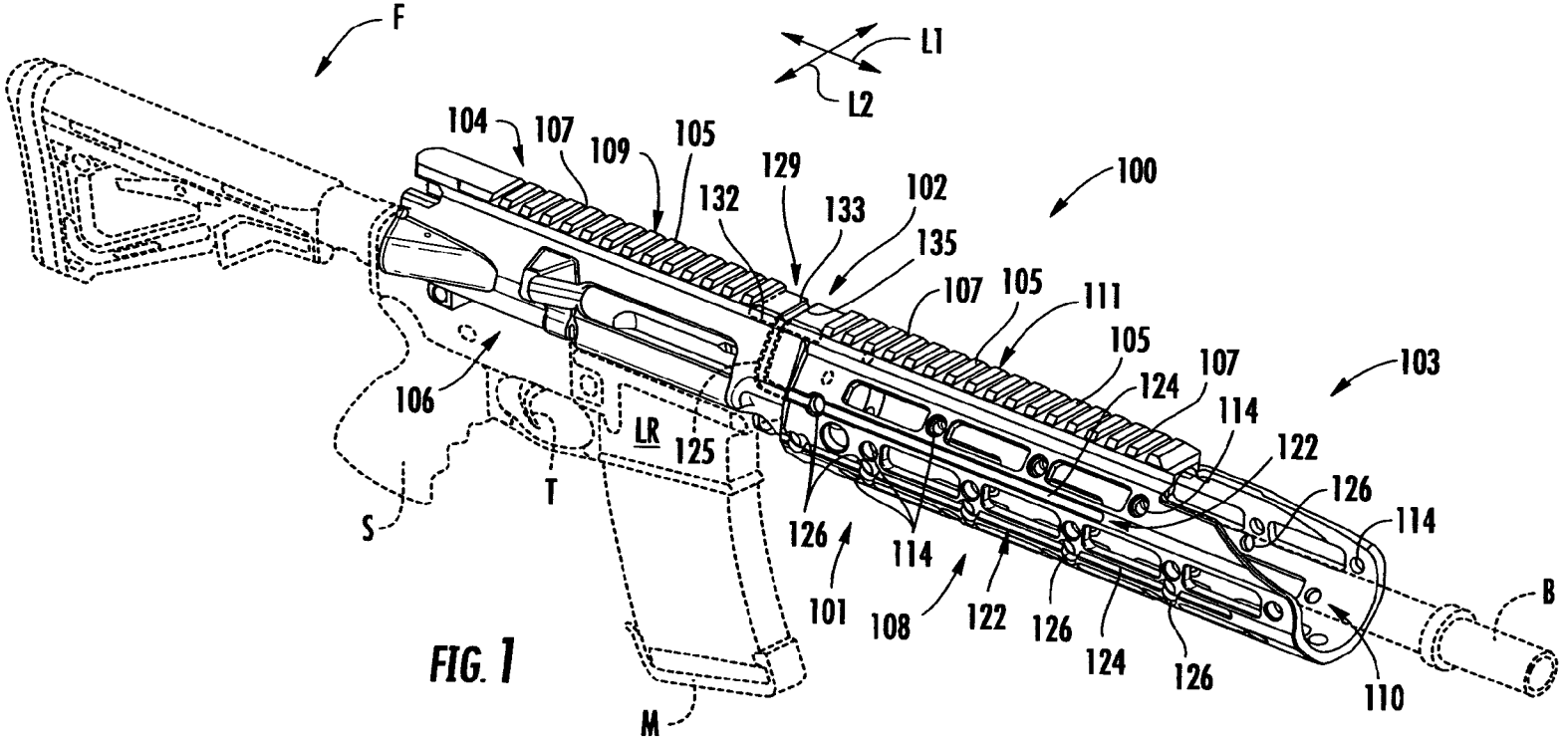
FIG. 1 is an isometric view of a monolithic upper receiver/hand guard with an optics rail interrupted by a crossover cable guide according to an exemplary embodiment of the disclosure.

Referring now to the drawings in which like numerals indicate like parts throughout the several views, the figures illustrate one example embodiment of monolithic upper receiver/hand guard according to the principles of the present disclosure for use in a firearm such as an M4, M16, AR-15, SCAR, AK-47, HK416, ACR or similar type firearm. However, it will be understood that the principles of the cable routing features of the present invention can be used in various types of firearms including shotguns, rifles and other long guns, and other firearms. The following description is provided as a teaching of exemplary embodiments; and those skilled in the relevant art will recognize that many changes can be made to the embodiments described. It also will be apparent that some of the desired benefits of the embodiments described can be obtained by selecting some of the features of the embodiments without utilizing other features. Accordingly, those skilled in the art will recognize that many modifications and adaptations to the embodiments described are possible and may even be desirable in certain circumstances, and are a part of the invention. Thus, the following description is provided as illustrative of the principles of the embodiments and not in limitation thereof, since the scope of the invention is defined by the claims.

FIG. 1 illustrates a monolithic upper receiver/hand guard 100 for a firearm (shown in phantom lines F) with a crossover cable guide 102 formed along an interrupted top rail 104 in one exemplary embodiment. In the illustrated embodiment, the monolithic upper receiver/hand guard 100 includes an upper receiver 106 and a hand guard section 108 that is shown as being integrally formed with the upper receiver 106. Alternatively, the hand guard and upper receiver can be separately formed and can be mounted/coupled together. The upper receiver 106 and/or the hand guard section 108 can be mounted to a lower receiver or chassis LR, which can include a fire control including trigger T, a magazine well and magazine M, a barrel B and/or a buttstock portion which can include a hand grip/stock S. The monolithic upper receiver/hand guard 100 and the associated firearm features also can be otherwise shaped, arranged, positioned, and/or configured without departing from the disclosure.

As shown in FIG. 1, the interrupted top rail 104 can extend in a generally longitudinal direction L1, and the monolithic upper receiver/hand guard 100 can have a first side 101 and a second side 103 spaced apart in a generally lateral direction L2 on opposing sides of the interrupted top rail 104. In one embodiment, a barrel and a gas operating system can be removably mounted at the forward end of the upper receiver 106 in the longitudinal, axial opening 110 of the hand guard section 108 so that the hand guard section extends over and surrounds at least a portion of the barrel. The gas operating system can be a direct impingement type system or an indirect system with an operating rod or piston. Alternatively, a gas operating system can be omitted. A bolt assembly can translate axially in both forward and rearward directions along the upper receiver section 106 during the firing cycle and generally is located behind and in communication with a chamber portion of the barrel. The bolt assembly can be operable for loading a round of ammunition into the chamber portion and ejecting a spent casing from the firearm during a firing operation.

As shown in FIG. 1, the interrupted optics (or top) rail 104 can be integral with the upper receiver section 106 and the upper hand guard section 108. Alternatively, the interrupted top rail 104 could comprise one or more separate pieces that are affixed or mounted to the upper receiver 106 and/or the hand guard section 108. In one embodiment, the interrupted top rail 104 is a mil-std Picatinny rail or other accessory rail for attaching various accessories or peripheral devices. In one embodiment, the interrupted top rail 104 includes a series of lugs or other projections 105 with rail grooves 107 interposed therebetween. In an exemplary embodiment, the projections 105 generally are evenly spaced along the interrupted top rail 104 except where the rail is interrupted as described below.

As shown in FIG. 1, the interrupted top rail 104 generally is not formed as a contiguous rail, but rather has a broken or sectioned design/construction. Instead, in the illustrated embodiment, the crossover cable guide 102 is disposed in a cut-out section such as a gap or channel 129 formed in the interrupted top rail 104. In the illustrated embodiment, the channel 129 generally is disposed where the hand guard section 18 meets the upper receiver 106. In another embodiment, the one or more channels 129 are disposed at any suitable location along the upper receiver 106 or the hand guard section 108. In the illustrated embodiment, the interrupted top rail 104 includes a first rail portion 109 spaced apart from a second rail portion 111 by the channel 129. The interrupted top rail 104 could be otherwise shaped, arranged, positioned, and/or configured without departing from the disclosure.

Figure 4:
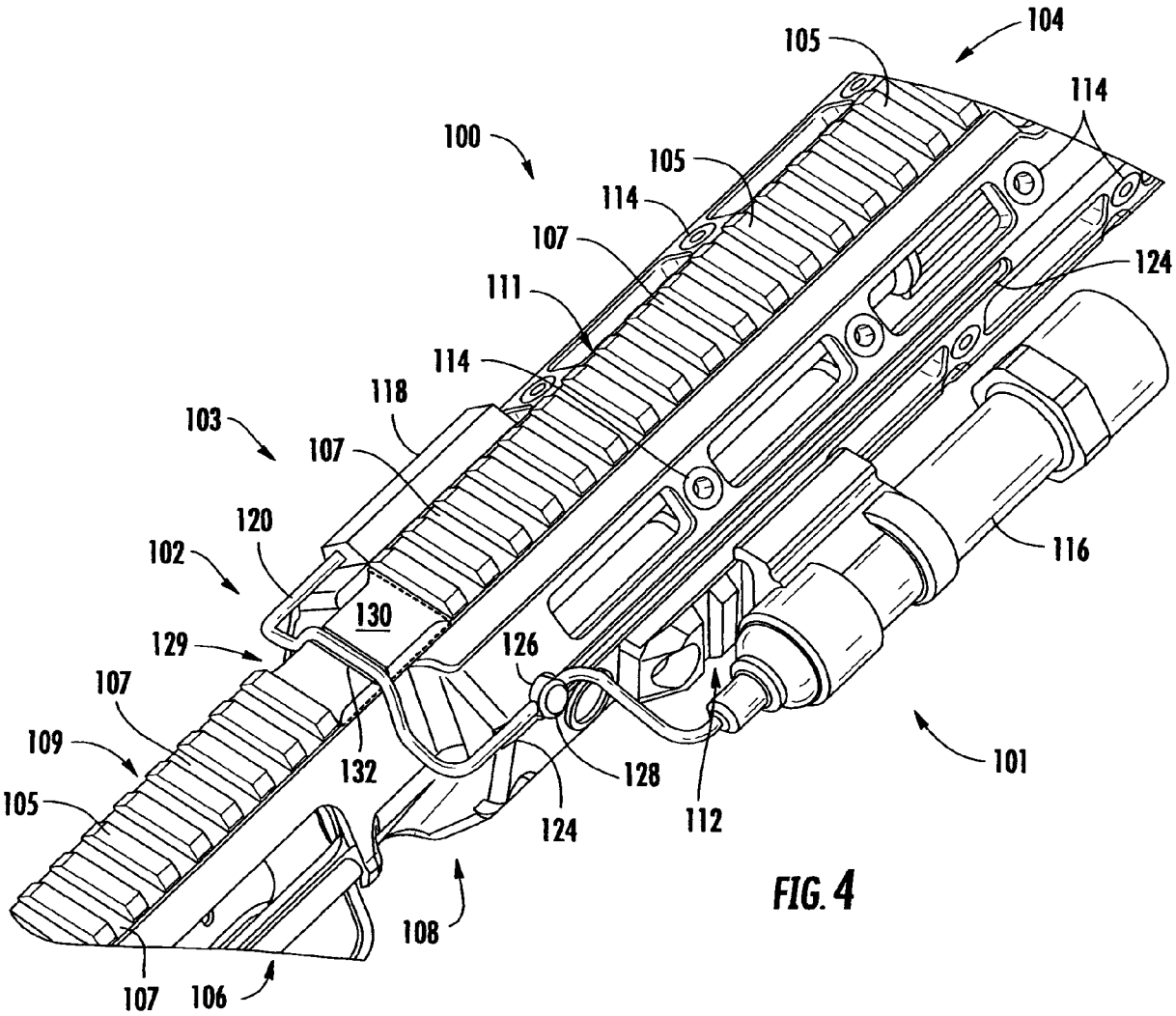
FIG. 4 is a perspective view of the monolithic upper receiver/hand guard of FIG. 1 with attached peripheral devices according to an exemplary embodiment of the disclosure.

Additional accessory rail units 112 (FIG. 4) also can be mounted to or integral with the sides of the upper receiver 106 and/or the sides and/or bottom of the hand guard section 108. In the embodiment shown in FIG. 4, the accessory rail unit 112 is secured to the hand guard section 108 such as by mechanical fasteners (e.g., a screw, bolt, clip, etc.). For example, the fasteners can extend through one or more bores in the accessory rail unit 112 and engage (e.g., threadedly engage) respective bores 114 in the hand guard section 108. Accordingly, any suitable number of accessory rail units 112 can be mounted to the hand guard section 108 and/or the upper receiver section 106. Additionally, the accessory rail units 112 can be provided with different lengths as needed. The interrupted top rail 104 and the accessory rail units 112 can support accessories or peripheral devices, such as sights, illumination devices, vision enhancing devices, launchers, laser aiming devices, Global Positioning devices, and/or other devices.

Some accessories or peripheral devices that may be used with the monolithic upper receiver/hand guard 100 may include cables and/or wires for power, control signals, communication signals, and/or antennas. For example, a power source could be mounted to the bottom of the hand guard section 108 (or in the buttstock or chassis portion of the firearm) and connected to multiple peripheral devices that require power via respective power cables. In one exemplary embodiment shown in FIG. 4, a laser or flashlight 116 is mounted to a accessory rail unit 112 on the first side 101 of the hand guard section 108, and a control switch 118 (e.g., a pressure plate or other, similar switch/control) is mounted to one of the accessory rail units 112 on the second side 103 of the hand guard section 108. A cable 120 is connected to the flashlight 116 and to switch 118 for transmitting an on/off control signal from the switch to the flashlight.

As shown in FIG. 1, cable management features 122 in conjunction with the crossover cable guide also can be incorporated into the monolithic upper receiver/hand guard 100 to help manage/guide and protect the cables, such as cable 120. The cable management features 122 can include the crossover cable guide and one or more grooves or slots 124 molded or cut into the hand guard section 108. One or more grooves or slots optionally can be formed in the upper receiver 106, such as shown by dashed lines 125 in FIG. 1. In the illustrated embodiment, the slots 124 are shown as generally longitudinally extending; however, the slots could be otherwise oriented or configured as desired. In one embodiment, the slots 124 can have a depth below the surface of the hand guard section 108 that is equal to at least a portion of the cross-sectional diameter of the cable, and can be at a depth that is greater than or equal to the cross-sectional diameter of the cable. Accordingly, the cable is at least partially contained by the slot below the surface of the hand guard section, and the entire cable could be below the surface of the hand guard section.

Figure 2:
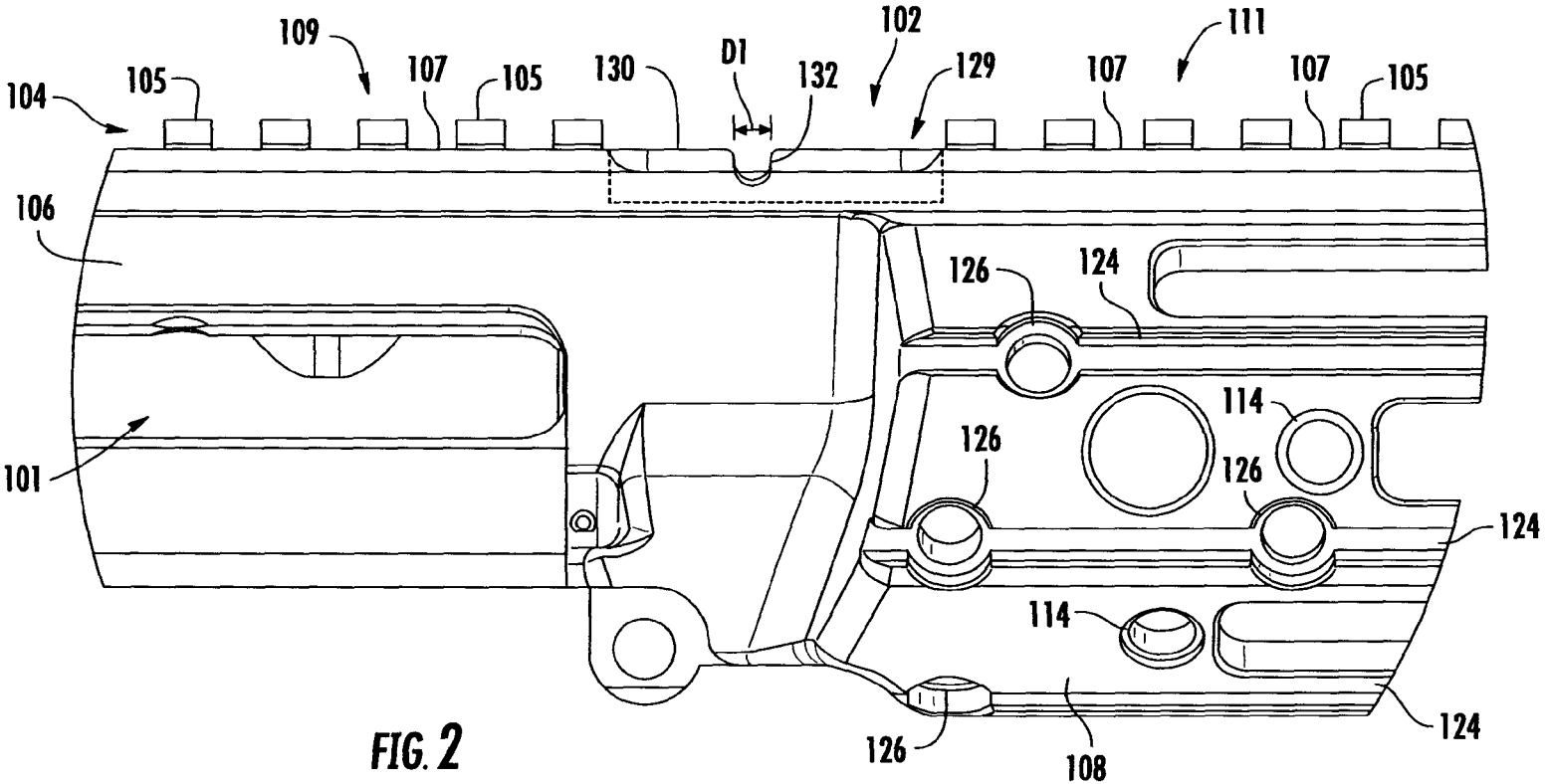
FIG. 2 is a side view of the interrupted top rail and crossover cable guide of the monolithic upper receiver/hand guard of FIG. 1.
Figure 3:
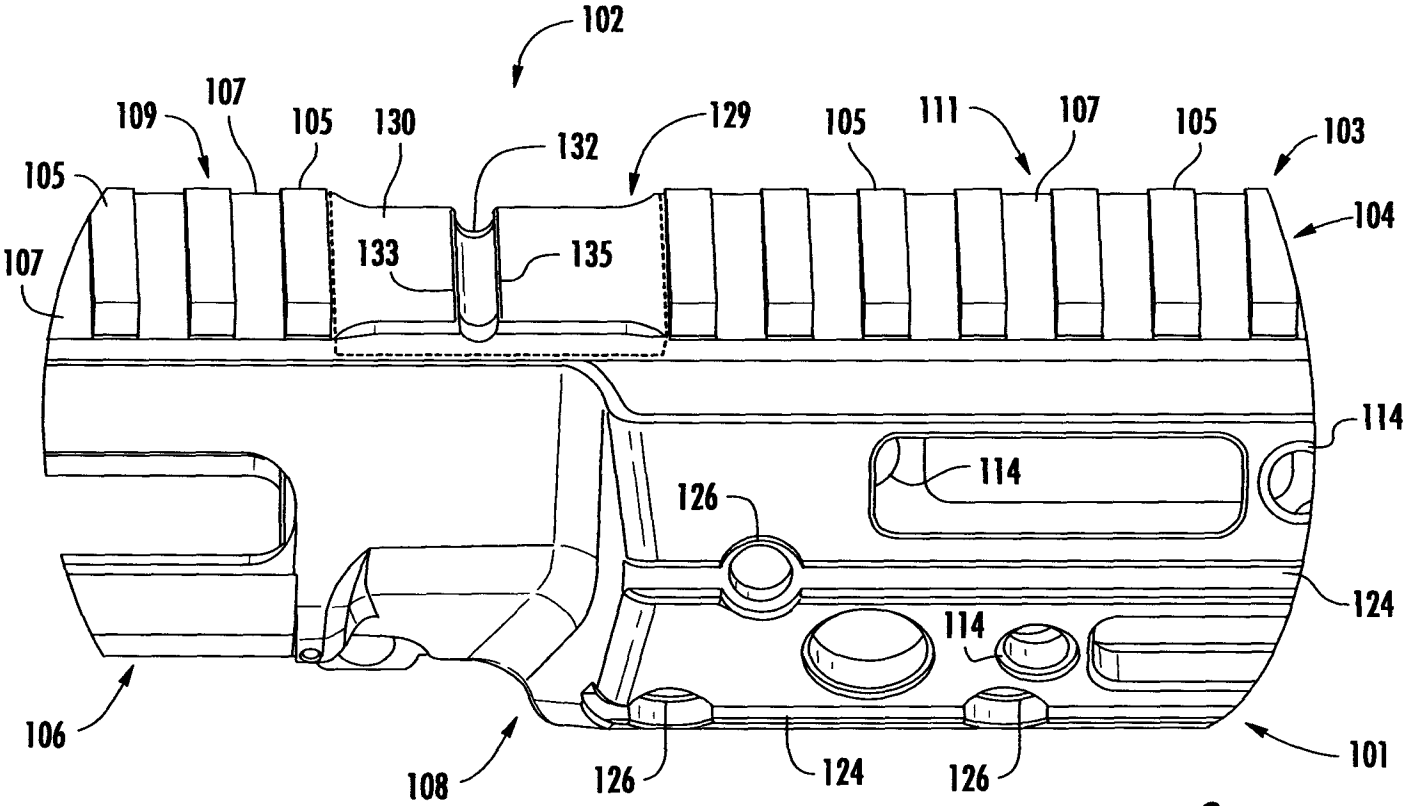
FIG. 3 is a perspective view of the interrupted top rail and crossover cable guide of the monolithic upper receiver/hand guard of FIG. 1.

As shown in FIGS. 1-3, the slots 124 can include one or more bores 126 disposed along the length of the slots 124. A cable retainer 128 (FIG. 4) can be disposed on a cable (e.g., clipped onto the cable or integral with the cable) and can engage a bore 126 for securing the cable in the respective slot 124. For example the cable retainers 128 can threadedly engage the respective bores 126, can snap fit or otherwise clip into the respective bores 126, or can be otherwise engaged with the respective bores. For example, in one embodiment, the cable retainers 128 can have a U-shaped portion and two or more barbs adjacent the opening of the U-shaped portion. One or more of the cable retainers 128 can slide over the cable 120 so that the cable is received in the U-shaped portion, and the barbed end of the cable receiver 128 can be pushed into a respective bore 126 so that the barbs engage the interior surface of the hand guard section 108 to retain the cable retainer 128 in the bore 126. The interrupted top rail 104, the accessory rail units 112, and the cable management features 122 thereof can be otherwise shaped, arranged, positioned, and/or configured without departing from the disclosure.

In the illustrated embodiment, the crossover cable guide 102 will be included to help guide the passage of the cable 120 or another cable/wire from one side of the monolithic upper receiver/hand guard 100 to the other. Accordingly, the cable can pass over the monolithic upper receiver/hand guard 100 without interfering with the mounting or operation of optics or other peripheral devices mounted on the interrupted top rail 104, and can be substantially flush-mounted with or otherwise integrated into the upper receiver and/or hand guard section along channels/slots 125 and 124 (FIG. 1). Additionally, a cable that is engaged with the crossover cable guide 102 will be less likely to get snagged or to interfere with a user's hands than a cable that is passed under the monolithic upper receiver/hand guard 100.

As shown in FIGS. 2-3, the crossover cable guide 102 is disposed at the top of the monolithic upper receiver/hand guard 100, forming a gap or channel 129 in the interrupted top rail 104 where the upper receiver section 106 meets the hand guard section 108. Alternatively, the monolithic upper receiver/hand guard 100 can include any suitable number of crossover cable guides 102 interrupting the interrupted top rail 104 anywhere along the top of the monolithic upper receiver/hand guard 100. The crossover cable guide 102 can be integrally formed with the upper receiver section 106, the hand guard section 108, and/or the interrupted top rail 104. Alternatively, the channel 129 can be molded or machined into the top portion of the monolithic upper receiver/hand guard 100, and the crossover cable guide 102 can be a separate piece that is mounted into the channel 129, such as by adhesive, mechanical fasters, press fitting, and any other suitable mounting. In such an embodiment, the crossover cable guide 102 can be formed as a replaceable part with varying size/configuration of one or more cable grooves 132. Generally, in one example embodiment, the channel 129 can be a spacing between two of the projections 105 and/or grooves 107 of the interrupted top rail 104, wherein the channel 129 generally is larger than each of the grooves 107. Accordingly, the channel 129 can be a distinctive break in the interrupted top rail 104. The channel 129 could be otherwise shaped, arranged, positioned, and/or configured without departing from the disclosure.

As shown in FIG. 2, the upper surface 130 of the crossover cable guide 102 can be generally planar with the lower surfaces of the grooves 107 of the interrupted top rail 104. Alternatively, the upper surface 130 could be countersunk further into the top of the monolithic upper receiver/hand guard 100 or raised above the bottoms of the grooves 107 of the interrupted top rail 104. The crossover cable guide 102 further will include at least one cable groove 132, which is shown in the illustrated embodiment as being generally U-shaped and as generally extending in a lateral direction with respect to the longitudinal orientation of the interrupted top rail 104 and the monolithic upper receiver/hand guard 100. Other configurations or shapes of the groove(s) 132 also can be provided. At least a portion of the diameter of a cable received in the cable groove 132 is disposed below the upper surface 130 of the crossover cable guide 102, and, in one embodiment, the entire diameter of the cable is disposed below the upper surface 130.

In one embodiment, the cable groove 132 could include retaining features for retaining a cable. For example, the groove 132 can be provided with one or more protrusions that extend from one or both surfaces 133/135 of the cable groove 132 proximate the upper surface 130 of the crossover cable guide. Alternatively, or in addition, a width D1 of the cable groove 132 (FIG. 2) can be slightly less than the cross-sectional diameter of a cable so that when the cable is pressed into the groove, the side walls of the groove squeeze the cable therebetween and help retain the cable in the groove. The cable groove 132 also can be sized to receive a single cable or multiple cables side-by-side and/or in an overlapping configuration. Each crossover cable guide 102 further can include more than one cable groove 132 as needed or desired. The crossover cable guide 102 can be omitted or otherwise shaped arranged, positioned, and/or configured without departing from the disclosure. For example, the crossover cable guide 102 could include a latch or cover for helping to close at least a portion of the grove and retain a cable therein, or could include a sliding section incorporating the cable groove(s) 132 therein for adjusting the position of this groove.

Figure 5A:
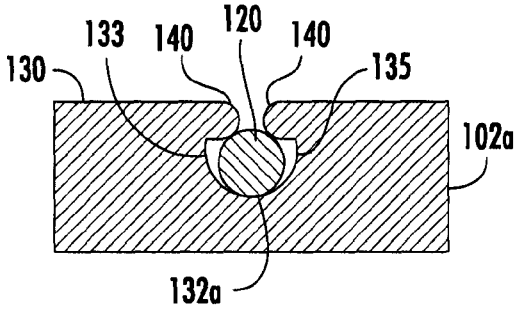
FIGS. 5A-5D are schematic cross-sectional views of different cable grooves for a crossover cable guide.

According to exemplary embodiments of the disclosure, FIGS. 5A-5D show various exemplary cable groove configurations for the crossover cable guide. For example, FIG. 5A shows a crossover cable guide 102*a* with a cable groove 132*a*. One or more protrusions 140 can extend from one or both surfaces 133/135 of the cable groove 132*a* proximate the upper surface 130 of the crossover cable guide 102*a*. The protrusions 140 can extend along the lateral length of the cable groove 132*a*. In another embodiment, the protrusions 140 generally can be shorter than the length of the cable groove 132*a*, and one or more protrusions can extend from the surfaces 133/135 at one or more locations along the length of the groove. In the exemplary embodiment shown in FIG. 5A, the cable 120 can be forced to deform to move past the protrusions 140 when inserting the cable 120 into the cable groove 132*a*, or when removing it therefrom. Accordingly, the protrusions 140 help prevent unwanted removal of the cable 120 from the cable groove 132*a*. The cable groove 132*a* and the protrusions 140 could be otherwise shaped, arranged, positioned, and/or configured without departing from the disclosure.

Figure 5B:
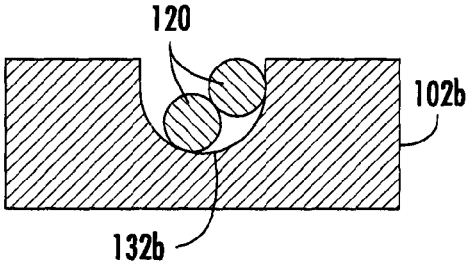
Figure 5C:
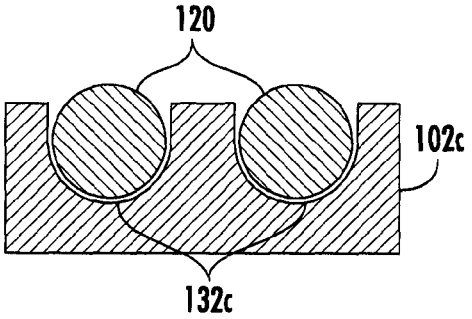
Figure 5D:
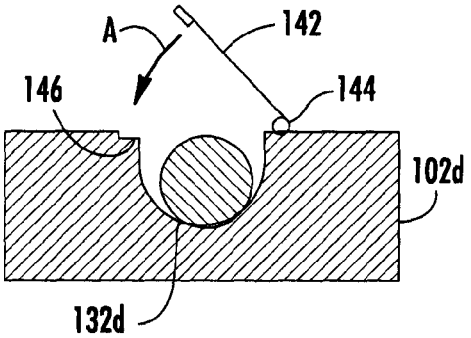

FIG. 5B shows an exemplary crossover cable guide 102*b* with a cable groove 132*b* receiving two cables 120 in an overlapping relationship. Alternatively, the cables 120 could be in a side-by-side or vertical arrangement, and/or the cable groove 132*b* could be configured to receive more than two cables. In one embodiment, the cables 120 could be different sizes. FIG. 5C shows an exemplary crossover cable guide 102*c* with two cable grooves 132*c*. Each of the cable grooves 132*c* receives a cable 120. Alternatively, one or both of the cable grooves 132*c* can receive more than one cable 120. In one embodiment, one of the cable grooves 132*c* could be sized to receive a differently-sized cable than the other cable groove 132*c*. FIG. 5D shows a further alternative crossover cable guide 102*d* with a cable groove 132*d* having an exemplary latch 142 for retaining the cable 120 in the cable groove 132*d*. The latch 142 can be pivoted about a hinge 144 in the direction of arrow A to selectively engage a locking feature 146. Alternatively, the locking feature 146 could be omitted and the latch 142 could be biased in the direction of arrow A by a spring, for example. The hinge 144 could also be omitted and the latch 142 could be a generally resilient cantilever that can be bent away from the groove 132*d* a sufficient distance to remove the cable 120. The crossover cable guide and the cable grooves and/or retaining features thereof could be otherwise shaped, arranged, positioned, and/or configured without departing from the disclosure.

In operation, the accessory rail units 112 (FIG. 4) can be mounted on either side of the hand guard section 108 with screws or other fasteners engaging respective bores 114 in the hand guard section 108. A device such as flashlight 116 and the control switch 118 (or other connected accessories) can be mounted on the respective accessory rail units 112, such as by clamping into the respective grooves or slots of the accessory rail units. A portion of the cable 120 can be positioned in one of the slots 124 of the cable routing features 122 adjacent the accessory rail unit 112 and the flashlight 116, and a cable retainer 128 can engage the cable and one of the bores 126 in the respective slot 124 to retain the cable 120 in the slot 124. Similarly, a portion of the cable 120 adjacent the control switch 118 could be retained in an adjacent slot 124, although in the illustrated embodiment shown in FIG. 4, the cable is not shown as being retained in a slot 124 on the control switch side of the hand guard section 108. In one embodiment, the cable 120 could be retained by multiple cable retainers 128 engaging respective bores 126 in the slot 124. A portion of the cable 120 extending over the monolithic upper receiver/hand guard 100 can be inserted into the groove 132 of the crossover cable guide 102 to retain the cable as it passes between the sides 101, 103 of the monolithic upper receiver/hand guard. A scope (not shown) or another device can be mounted to the interrupted top rail 104 on one or both sides of the channel 129, and the cable 120 is restrained from interfering with the operation of the scope. The features of the monolithic upper receiver/hand guard can be otherwise used and can be used with any suitable accessory, peripheral device, cable, wire, etc. without departing from the disclosure.

Figure 6:
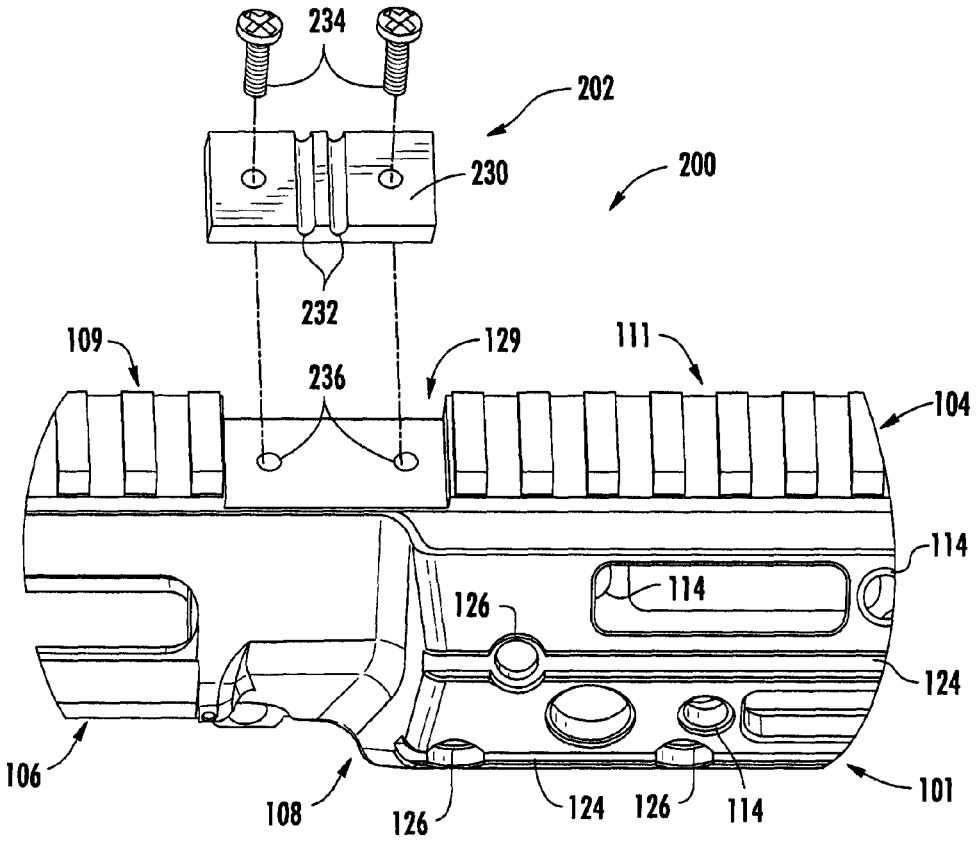
FIG. 6 is a perspective view of an interrupted top rail and crossover cable guide of a monolithic upper receiver/hand guard an alternative embodiment of the disclosure.

FIG. 6 is view of a portion of a monolithic upper receiver/hand guard according to an alternative embodiment of the disclosure. The alternative embodiment is generally similar to the embodiment of FIGS. 1-4, except for variations noted and variations that will be apparent to one of ordinary skill in the art. Accordingly, similar or identical features of the embodiments have been given like or similar reference numbers. As shown in FIG. 6, a channel 229 is formed in the interrupted top rail 104. In one embodiment, the channel 229 forms a receiving portion in the monolithic upper receiver/hand guard 200 for one or more crossover cable guide inserts 202. As shown in FIG. 6, the crossover cable guide insert 202 includes two cable grooves 232 formed in the upper surface 230. Each of the cable grooves 232 can receive one or more cables 120. In the illustrated embodiment, the crossover cable guide insert 202 is mounted in the channel 229 by two screws 234 received in respective screw holes 236 in the channel 229. Alternatively, any suitable number of screws can be used to secure the crossover cable guide insert 202 in the channel 229, or the crossover cable guide insert 202 could be mounted in the channel 229 by one or more clips and/or other mechanical fasteners and/or one or more adhesives.

In one embodiment, the crossover cable guide insert 202 can be interchangeable with other crossover cable guide inserts having similar or different cable groove arrangements. For example, the interchangeable crossover cable guide inserts can include one or more grooves including, but not limited to those having features as shown in FIGS. 5A-5D. In one embodiment, the channel 229 and the crossover cable guide inserts 202 can be configured so that one or multiple crossover cable guide inserts selectively can be received in the channel 229. For example, a large crossover cable guide insert mounted in the channel 229 can be removed and two or more smaller crossover cable guide inserts could be mounted in the same channel 229. The crossover cable guide insert 202 and/or the channel 229 could be otherwise shaped, arranged, and/or configured without departing from the disclosure.

It therefore can be seen that the construction of the monolithic upper receiver/hand guard with a top rail interrupted by a crossover cable guide according to the principles of the present disclosure provides features for controlling and guiding cables for peripheral devices that may be mounted to the monolithic upper receiver/hand guard. Thus, the crossover cable guide facilitates a user's easy attachment and removal/replacement of peripheral devices to the monolithic upper receiver/hand guard of a firearm while reducing the interference of cables with the operation of the peripheral devices and/or the firearm.

Those skilled in the art will appreciate that many modifications to the exemplary embodiments are possible without departing from the scope of the invention. In addition, it is possible to use some of the features of the embodiments described without the corresponding use of the other features. Accordingly, the foregoing description of the exemplary embodiments is provided for the purpose of illustrating the principle of the invention, and not in limitation thereof, since the scope of the invention is defined solely be the appended claims.

What is claimed is:

1. An upper receiver and hand guard for a firearm having a first side and a second side, the upper receiver and hand guard comprising:

an interrupted top rail disposed along at least a portion of the upper receiver and hand guard for mounting accessories to the upper receiver and hand guard, the interrupted top rail comprising a channel formed at a selected location therealong; and;

a crossover cable guide disposed in the channel of the interrupted top rail for receiving at least a portion of an accessory cable extending between the first side and the second side.

2. The upper receiver and hand guard of claim 1, wherein the interrupted top rail comprises a first rail portion and a second rail portion, and the second rail portion is spaced apart from the first rail portion by the channel of the interrupted top rail.

3. The upper receiver and hand guard of claim 1, wherein the crossover cable guide comprises an upper surface and at least one laterally extending cable groove formed in the upper surface, the cable groove is configured to receive and guide at least a portion of the accessory cable from the first side of the firearm to the second side of the firearm at a location below the upper surface.

4. The upper receiver and hand guard of claim 3, wherein the interrupted top rail comprises a series of spaced lugs defining rail grooves therebetween, and wherein the upper surface of the crossover cable guide generally is coplanar with the series of rail grooves.

5. The upper receiver and hand guard of claim 3, wherein the crossover cable guide comprises a retaining feature for retaining the at least one accessory cable in the at least one cable groove.

6. The upper receiver and hand guard of claim 1, wherein the crossover cable guide comprises a plurality of cable grooves formed at spaced locations, each adapted to receive and guide at least a portion of a respective accessory cable.

7. The upper receiver and hand guard of claim 1, further comprising at least one slot formed in the upper receiver and hand guard on the first side of the firearm adjacent the crossover cable guide for at least partially receiving the accessory cable.

8. The upper receiver and hand guard of claim 1, wherein the crossover cable guide comprises an interchangeable insert mounted in the channel of the interrupted top rail.

9. The upper receiver and hand guard of claim 1, wherein the upper receiver and hand guard is a monolithic upper receiver and hand guard, and the interrupted top rail is integrally formed with the monolithic upper receiver and hand guard.

10. The upper receiver and hand guard of claim 9, wherein crossover cable guide is integrally formed with the monolithic upper receiver and hand guard.

11. A firearm comprising:

a barrel;

an upper receiver engaging the barrel and having a hand guard extending forwardly therefrom and along the barrel, the upper receiver and hand guard having a first side and a second side; and a cable management feature comprising:

an interrupted top rail extending along the upper receiver and hand guard, and having a channel formed at a selected location therealong, wherein the interrupted top rail is configured for mounting accessories to the firearm; and a crossover cable guide located within the channel of the interrupted top rail for receiving and directing at least one accessory cable extending between the first side and the second side of the upper receiver and/or hand guard.

12. The firearm feature of claim 11, wherein the crossover cable guide defines at least one cable groove for receiving at least a portion of the at least one accessory cable.

13. The firearm feature of claim 12, wherein the at least one cable groove comprises a plurality of cable grooves defined in the crossover cable guide for receiving at least a portion of a respective accessory cable.

14. The firearm feature of claim 12, wherein the crossover cable guide comprises a retaining feature for retaining the at least one accessory cable in the at least one cable groove.

15. The firearm feature of claim 14, wherein the retaining feature comprises at least one protrusion extending from at least one side surface of the cable groove.

16. The firearm feature of claim 11, wherein the interrupted top rail extends in a generally longitudinal direction, and the cable groove of the crossover cable guide extends in a generally lateral direction.

17. The firearm feature of claim 16, wherein the upper receiver and hand guard comprise a monolithic upper receiver/hand guard, the interrupted top rail extends along at least a portion of the monolithic upper receiver/hand guard, the cable management feature further comprises at least one slot formed in the monolithic upper receiver/hand guard for at least partially receiving the at least one accessory cable, and at least a portion of the at least one slot extends in the generally longitudinal direction.

18. The firearm feature of claim 11, wherein the crossover cable guide comprises an interchangeable insert mounted in the channel of the interrupted top rail.

* * * * *